US011060341B1

(12) United States Patent
Sprague

(10) Patent No.: US 11,060,341 B1
(45) Date of Patent: Jul. 13, 2021

(54) DOOR RAIL SYSTEM AND METHOD

(71) Applicant: Gary Sprague, Visalia, CA (US)

(72) Inventor: Gary Sprague, Visalia, CA (US)

( * ) Notice: Subject to any disclaimer, the term of this patent is extended or adjusted under 35 U.S.C. 154(b) by 22 days.

(21) Appl. No.: 16/817,439

(22) Filed: Mar. 12, 2020

(51) Int. Cl.
*E06B 3/54* (2006.01)
*E06B 3/00* (2006.01)

(52) U.S. Cl.
CPC ..... *E06B 3/549* (2013.01); *E06B 3/5454* (2013.01)

(58) Field of Classification Search
CPC ..... E06B 3/549; E06B 3/5454; E06B 3/5864
USPC ..... 52/204.5
See application file for complete search history.

(56) References Cited

U.S. PATENT DOCUMENTS 3,774,363 A * 11/1973 Kent ..... B60J 10/70 52/204.597
4,612,743 A * 9/1986 Salzer ..... E06B 3/28 49/501
7,963,077 B2 * 6/2011 Lin ..... E06B 3/72 52/204.597
8,181,405 B2 * 5/2012 Nash ..... E04F 11/1851 52/238.1
9,127,498 B1 * 9/2015 Ye ..... E06B 3/5821
9,303,444 B1 * 4/2016 Choi ..... E06B 7/28
9,366,382 B2 * 6/2016 Bonomi ..... F16M 13/022
9,540,861 B2 * 1/2017 Abdul Lathief ..... E06B 3/5871
10,731,402 B2 * 8/2020 Koster ..... E06B 3/9616
10,871,024 B2 * 12/2020 Carleton ..... E06B 1/36

* cited by examiner

*Primary Examiner* — Patrick J Maestri
*Assistant Examiner* — Joseph J. Sadlon
(74) *Attorney, Agent, or Firm* — Cohen IP Law Group, PC; Michael N. Cohen

(57) ABSTRACT

A rail system to support a door or other types of panels is disclosed. The doors and/or panels may include frameless glass panes. The rail system may include a longitudinal channel into which the bottom of the door may be received and secured. The system may include a clamping assembly that may provide clamping forces onto the opposing lateral surfaces of the door within the longitudinal channel to secure it therein. The clamping assembly may be controlled by a controlling assembly in combination with the housing to provide inward forces to the clamping members at two or more interfaces between the housing and the clamping assembly on each opposing side of the panel. In this way, the clamping forces applied to the panel by the clamping assembly are uniformly distributed across the vertical height of the clamping assembly. The rail system also includes a unitizing gasket configured to hold the elements of the clamping assembly in place during the system's assembly and use.

20 Claims, 9 Drawing Sheets

DOOR RAIL SYSTEM AND METHOD

COPYRIGHT STATEMENT

This patent document contains material subject to copyright protection. The copyright owner has no objection to the reproduction of this patent document or any related materials in the files of the United States Patent and Trademark Office, but otherwise reserves all copyrights whatsoever.

FIELD OF THE INVENTION

This invention relates to doors, including frameless glass door rail systems and methods.

BACKGROUND

Frameless heavy glass doors and panels for use with commercial and/or residential buildings typically utilize rail systems to provide support to the doors or panels while in use. The rail systems usually extend along one or more edges of the doors or panels (e.g., along the bottom edge) and are designed to maximize the structures' "frameless" appearance.

In some instances, the doors or panels are permanently secured within the rail systems such that if the doors or panels become broken or otherwise need replacement, the rail systems must also be replaced. This adds cost and additional labor.

In some instances, the doors or panels are removably configured with the rail systems, thereby avoiding this problem. However, current removable rail systems are difficult to assemble, do not provide a uniform attachment pressure to the doors or panels, and are generally bulky.

Accordingly, there is a need for a removable rail system for use with frameless glass panel doors or panels that is easy to install, that provides uniform attachment pressure to the doors or panels, and that are streamlined in appearance.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF EXEMPLARY EMBODIMENTS

As used herein, unless used otherwise, the following terms and abbreviations have the following meanings:

Outboard means towards the outside, and in the case of a rail system and associated panel, towards the area outside the rail system and panel. Unless otherwise stated, this will typically be depicted in the FIGS as the portion of the system to the left of the system's median plane.

Inboard means towards in the inside, and in the case of a rail system and associated panel, towards the area outside the rail system and panel. Unless otherwise stated, this will typically be depicted in the FIGS as the portion of the system to the right of the system's median plane.

Lateral means towards the side, and in the case of a rail system and associated panel, facing away from the middle (the median plane) of the guard railing or panel.

Medial means towards the middle, and in the case of a guard railing or panel, facing towards the middle (the median plane) of the guard railing or panel.

In general, the system according to exemplary embodiments hereof provides a glass door rail system and its method of use for providing support to a glass door. The door rail system includes a longitudinal channel within which the glass door is removably mounted and secured. It is understood that the door rail system also may be used for other types of structures such as glass panes and/or other types of panels. It is also understood that the system may be used to provide support to structures comprising materials other than glass.

Referring now to FIGS. 1-8, the system 10 according to exemplary embodiments hereof will be described in further detail.

Figure 1:
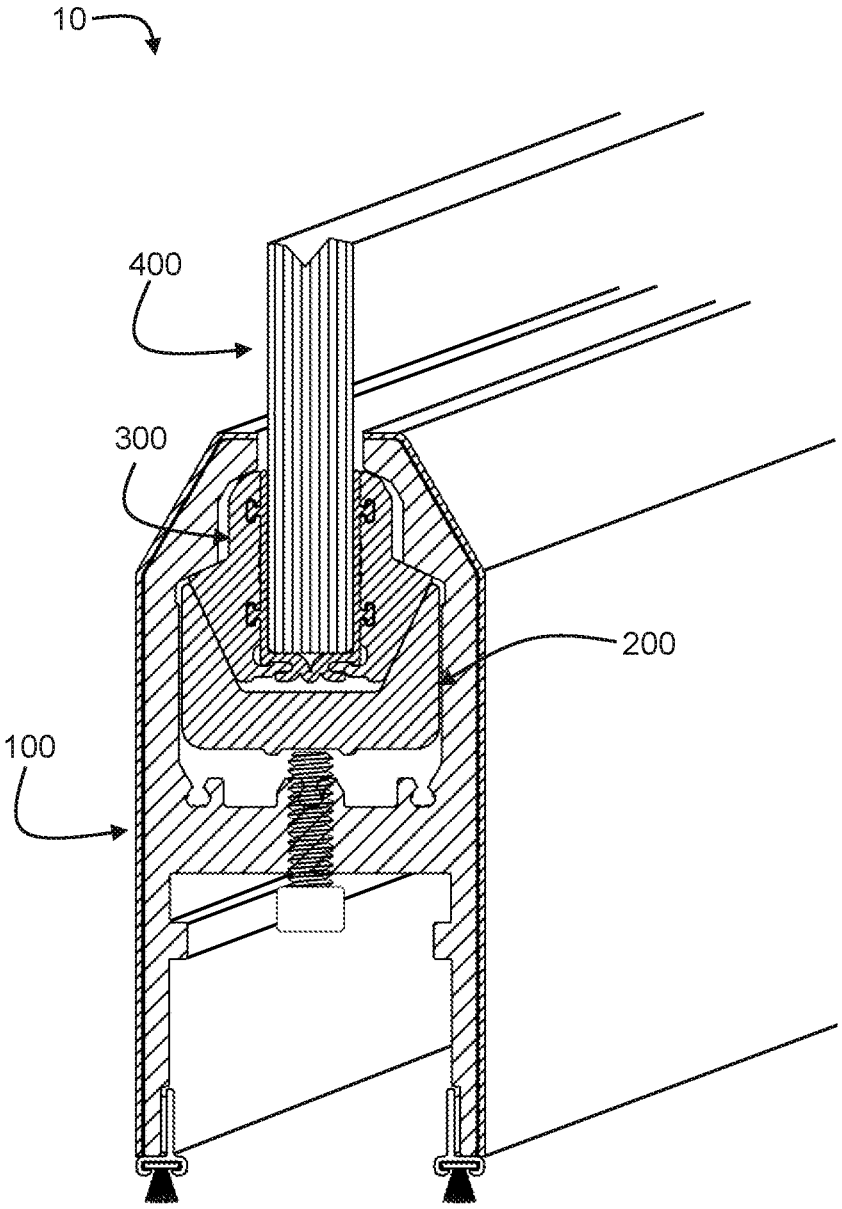
FIG. 1 shows aspects of a door rail system according to exemplary embodiments hereof.

In one exemplary embodiment hereof as shown in FIG. 1, the system 10 includes a housing 100 (also referred to as a base shoe member), a control assembly 200 and a clamping assembly 300. The system 10 may include other elements and components as necessary to fulfill its functionalities.

In general, the system 10 is adapted to secure and support the bottom portion of a panel 400 (e.g., the bottom edge of a glass door or pane). The control assembly 200 and the clamping assembly 300 are housed within the housing 100, and generally extend along the longitudinal length of the housing 100 as shown. The control assembly 200 in combination with the housing 100 control the inward clamping motions of the clamping assembly 300 as it engages with and supports the panel 400.

Housing Assembly

Figure 2:
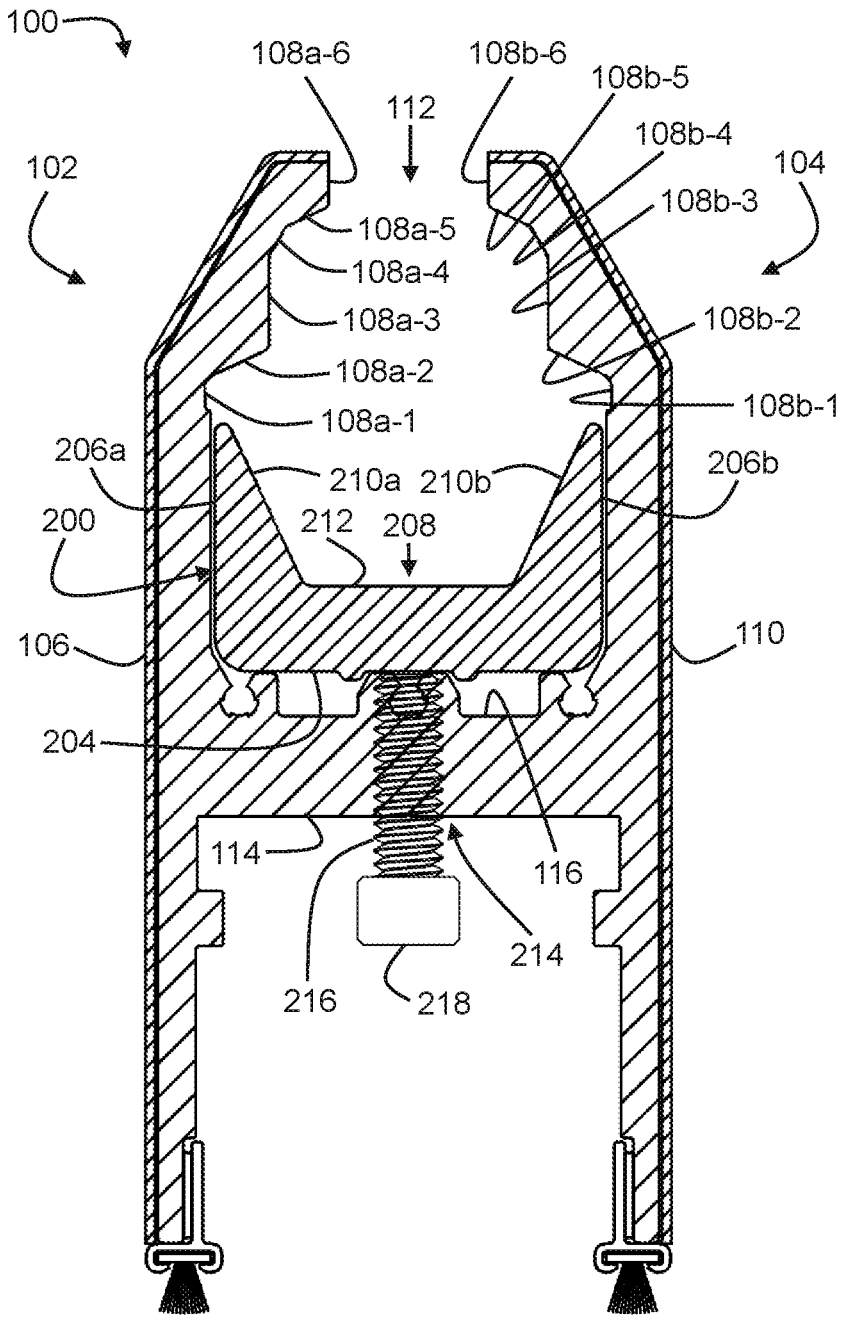
FIGS. 2-3 shows aspects of a housing assembly and a control assembly according to exemplary embodiments hereof.

In one exemplary embodiment as shown in FIG. 2, the housing 100 includes an outboard portion 102 and an inboard portion 104. The housing 100 may comprise aluminum or other materials and may be formed using an extrusion process or other processes. The outboard portion 102 includes an outboard lateral surface 106 and a plurality of separate and distinct medial surfaces 108*a*-1, 108*a*-2, 108*a*-3, . . . 108*a-n* (individually and collectively 108*a*). The inboard portion 104 includes an inboard lateral surface 110 and a plurality of separate and distinct medial surfaces 108*b*-1, 108*b*-2, 108*b*-3, . . . 108*b-n* (individually and collectively 108*b*). The outboard portion's medial surfaces 108*a* and the inboard portion's medial surfaces 108*b* define the housing's inner channel 112 within which the panel 400 may be received and secured. The outboard portion 102 and inboard portion 104 are joined by a base support 114 that extends laterally between the portions 102, 104 thereby defining the bottom 116 of the inner channel 112.

In one exemplary embodiment hereof, the outboard portion's medial surfaces 108*a* and the inboard portion's medial surfaces 108*b* generally mirror one another in regard to positioning, orientation, shape and size across the inner channel 112. However, this may not be necessary. As will be described in other sections, each medial surface 108*a*, 108*b* has a distinct and purposeful functionality in supporting and guiding the clamping assembly 300.

In one embodiment, a first outboard medial surface 108*a*-1 and a first inboard medial surface 108*b*-1 extend upward and generally upright from the bottom 116 of the channel 112. These surfaces 108*a*-1, 108*b*-1 may be generally vertical. A second outboard medial surface 108*a*-2 and a second inboard medial surface 108*b*-2 extend upward from the top of the first surfaces 108*a*-1, 108*b*-1, respectively, at inward inclined angles (towards the median plane of the channel 112). A third outboard medial surface 108*a*-3 and a third inboard medial surface 108*b*-3 extend from the top of the second surfaces 108*a*-2, 108*b*-2, respectively, upward and generally upright. These surfaces 108*a*-3, 108*b*-3 may be generally vertical. A fourth outboard medial surface 108*a*-4 and a fourth inboard medial surface 108*b*-4 extend upward from the top of the third surfaces 108*a*-3, 108*b*-3, respectively, at inward inclined angles (towards the median plane of the channel 112). A fifth outboard medial surface 108*a*-5 and a fifth inboard medial surface 108*b*-5 extend upward from the top of the fourth surfaces 108*a*-4, 108*b*-4, respectively, at inward inclined angles (towards the median plane of the channel 112). A sixth outboard medial surface 108*a*-6 and a sixth inboard medial surface 108*b*-6 extend from the top of the fifth surfaces 108*a*-5, 108*b*-5, respectively, upward and generally upright. These surfaces 108*a*-6, 108*b*-6 may be generally vertical. The purpose and functionality of each separate and distinct surface 108*a*, 108*b* will be described in detail in other sections.

Control Assembly

In one exemplary embodiment hereof, the control assembly 200 includes a mount 202 disposed in the lower portion of the inner channel 112. The mount 202 includes a bottom 204, outboard lateral surface 206*a* and inboard lateral surface 206*b*. The top of the mount 202 includes a top mount channel 208. The top mount channel 208 is formed by an outboard upper medial surface 210*a*, and inboard upper medial surface 210*b* and a bottom 212 joining the surfaces 210*a*, 210*b* and forming the bottom of the top mount channel 208. The outboard upper medial surface 210*a* may generally extend at an outward inclined angle (away from the median plane of the channel 208 towards the outboard portion 102) and the inboard upper medial surface 210*b* may generally extend at an outward inclined angle (away from the median plane of the channel 208 towards the inboard portion 104)

Figure 3:
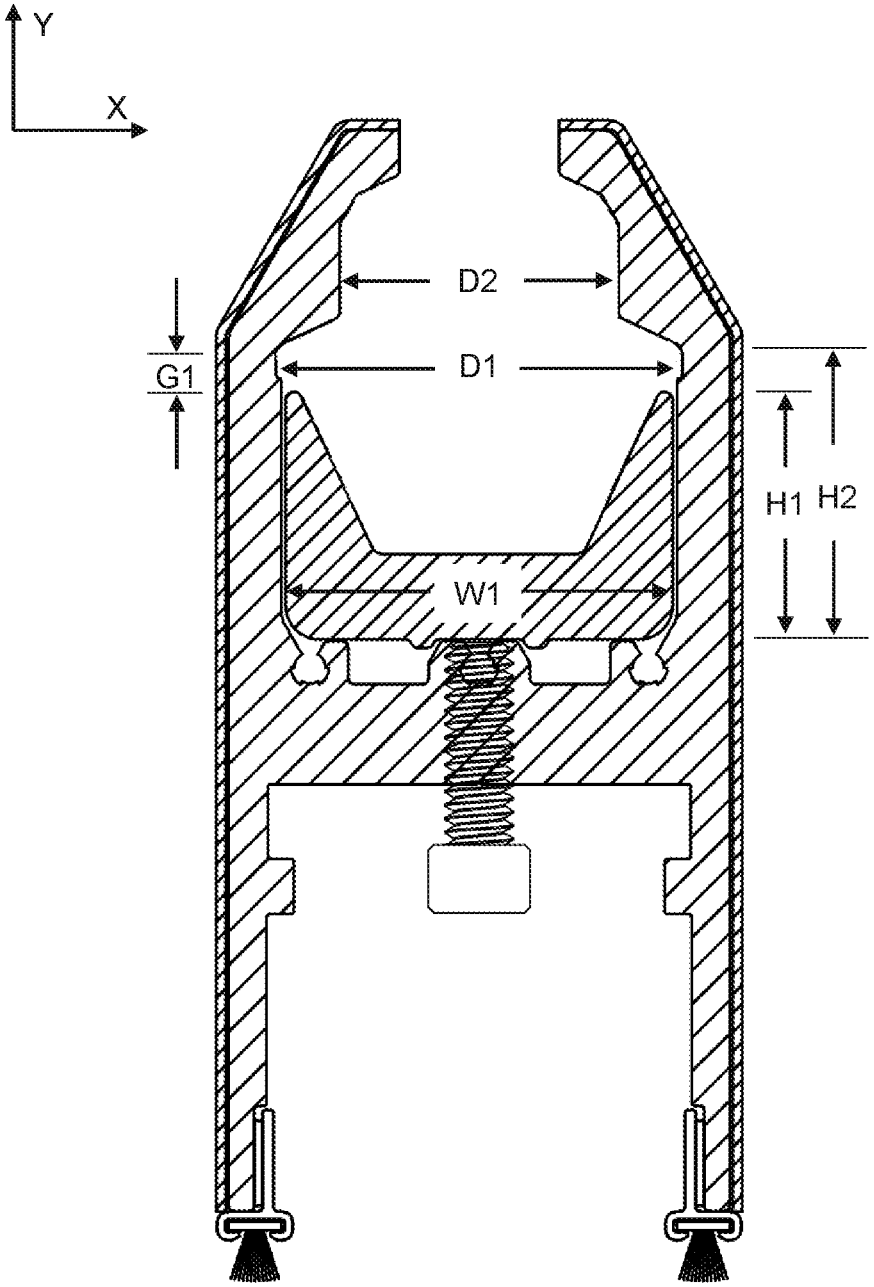

As shown in FIG. 3, the outer width W1 of the mount 202 generally corresponds to the distance D1 between the first outboard medial surface 108*a*-1 and the first inboard medial surface 108*b*-1 such that the mount 202 may be positioned in this area. In addition, while the surfaces 108*a*-1 and 108*b*-1 may preferably provide lateral support to the mount 202 and prevent it from moving side-to-side, it is preferable that the mount 202 be free to move vertically within the channel 112.

The height H1 of the mount 202 is preferably less than the height H2 of the first outboard and inboard medial surfaces 108*a*-1, 108*b*-1. In this way, the mount 202 may be free to move vertically a distance approximately equal to the difference between H1 and H2 (that is, a vertical distance equal to H1-H2). In some embodiments, H1-H2 may be in the range of about 2 mm-8 mm and preferably about 4 mm-5 mm. In some embodiments, H1-H2 may be 4 mm leaving 1 mm to accommodate a glass panel that may be slightly thicker than specified. It is understood that the range of H1-H2 may be greater or lesser depending on the requirements, and on the inclined angle of the outboard upper medial surface 210*a* and/or the inboard upper medial surface 210*b*. For the purposes of this specification, this gap defined by the difference between H1 and H2 within the channel 112 will be referred to as gap G1.

In some embodiments, one or more movement mechanisms are used to move the mount 202 upward within the gap G1. For example, in some embodiments a threaded opening 214 passes through the bottom 116 of the channel 112 (preferably positioned at the midpoint of D1) and is adapted to receive threaded fastening hardware 216 (e.g., a bolt or similar) therein. The threaded fastening hardware 216 preferably has a length that may extend through and out the top of the opening 214. In some embodiments, rotation of the threaded fastening hardware 216 within the threaded opening 214 causes the hardware 216 to move upward and/or downward within the opening 214.

With the mount 202 positioned within the channel 112 as described above, the threaded fastening hardware 216 may extend through the opening 214 and engage the bottom 204 of the mount 202. In this way, upward movement of the hardware 216 within the opening 214 may apply an upward force to the mount 202 causing it to move upward within the gap G1. In this configuration, the mount 202 may be free to move upward until the top of the mount 202 reaches the height H2 at which point the second outboard and inboard medial surfaces 108*a*-2, 108*b*-2 may provide a stop to the mount 202. At this position, downward movement of the hardware 216 within the opening 214 may allow the mount 202 to move downward (e.g., due to gravity) within the gap G1. Accordingly, the fastening hardware 216 may be used to move the mount 202 up and down within the gap G1. The fastening hardware 216 may include a head 218 to facilitate the rotation of the hardware 216 using one's fingers or a tool.

In other embodiments, other types of movement mechanisms may be used to apply an upward force to the mount 202 causing it to move upward within the gap G1. For example, a spring, a lever, a ratchet, other types of movement mechanisms and any combination thereof may be used to provide this functionality.

Clamping Assembly

Figure 4A:
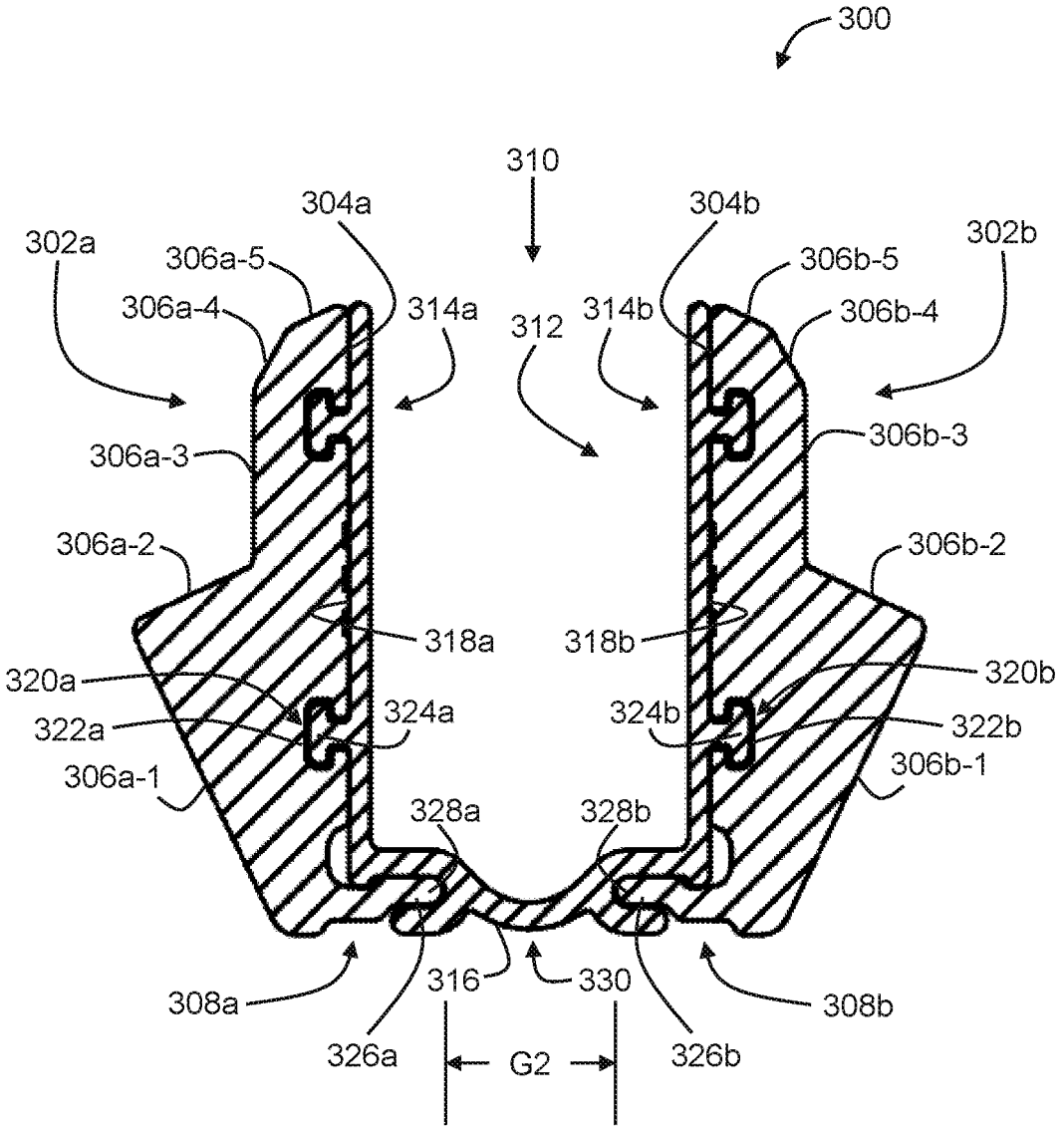
FIG. 4A shows aspects of a clamping assembly according to exemplary embodiments hereof.

In one exemplary embodiment hereof as shown in FIG. 4A, the clamping assembly 300 includes an outboard clamping member 302*a* and an inboard clamping member 302*b*. The clamping members 302*a*, 302*b* may comprise aluminum or other materials and may be formed using an extrusion process or other processes. The outboard clamping member 302*a* includes a medial surface 304*a*, a plurality of separate and distinct lateral surfaces 306*a*-1, 306*a*-2, 306*a*-3, . . . 306*a*-*n* (individually and collectively 306*a*), and a bottom 308*a* that joins the surfaces 304*a* and 306*a*. The inboard clamping member 302*b* includes a medial surface 304*b*, a plurality of separate and distinct lateral surfaces 306*b*-1, 306*b*-2, 306*b*-3, . . . 306*b*-*n* (individually and collectively 306*a*) and a bottom 308*a* that joins the surfaces 304*b* and 306*b*. Both medial surfaces 304*a*, 304*b* may be generally vertical while the lateral surfaces 306*a*, 306*b* may be oriented at different angles, each for different purposes, as will be described below.

In one exemplary embodiment hereof, the outboard clamping member 302*a* and the inboard clamping member 302*b* are positioned face-to-face opposite one another with each member's medial surfaces 304*a*, 302*b*, respectively, facing one another. In this way, the clamping members 302*a*, 302*b* may generally mirror one another in regard to positioning, orientation, shape and size as shown. In this position, the clamping members 302*a*, 302*b* may define a clamping channel 310 therebetween the two within which the panel 400 may be received and secured.

In one embodiment, a first outboard lateral surface 306*a*-1 and a first inboard lateral surface 306*b*-1 extend upward from the bottoms 308*a*, 308*b*, respectively, at outward inclined angles (away from the median plane of the combined members 302*a*, 302*b*). A second outboard lateral surface 306*a*-2 and a second inboard lateral surface 306*b*-2 extend upward from the top of the first surfaces 306*a*-1, 306*b*-1, respectively, at inward inclined angles (towards the median plane of the combined members 302*a*, 302*b*). A third outboard lateral surface 306*a*-3 and a third inboard lateral surface 306*b*-3 extend from the top of the second surfaces 306*a*-2, 306*b*-2, respectively, upward and generally upright. These surfaces 306*a*-3, 306*b*-3 may be generally vertical. A fourth outboard lateral surface 306*a*-4 and a fourth inboard lateral surface 306*b*-4 extend upward from the top of the third surfaces 306*a*-3, 306*b*-3, respectively, at inward inclined angles (towards the median plane of the combined members 302*a*, 302*b*). A fifth outboard lateral surface 306*a*-5 and a fifth inboard lateral surface 306*b*-5 extend upward from the top of the fourth surfaces 306*a*-4, 306*b*-4, respectively, at inward inclined angles (towards the median plane of the combined members 302*a*, 302*b*). The purpose and functionality of each separate and distinct outboard lateral surface 306*a*-1, 306*a*-2, 306*a*-3, 306*a*-4, 306*a*-5 and each separate and distinct inboard lateral surface 306*b*-1, 306*b*-2, 306*b*-3, 306*b*-4, 306*b*-5 will be described in detail in other sections.

In one exemplary embodiment hereof, the clamping assembly 300 includes a clamping gasket member 312 comprising silicon or another appropriate material. In some embodiments, the gasket member 312 is a single piece with a generally U-shaped and/or V-shaped cross-section. Accordingly, the gasket member 312 may include an outboard portion 314*a*, an inboard portion 314*b* and a bottom 316 connecting the outboard and inboard portions 314*a*, 314*b* thereby defining the U-shaped and/or V-shaped member 312. In other embodiments, the gasket's outboard portion 314*a* and inboard portion 314*b* may be formed separately and combined to form the overall gasket member 312.

In one exemplary embodiment hereof, the outboard clamping member's medial surface 304*a* is configured with the lateral surface 318*a* of the gasket's outboard portion 314*a*, and the inboard clamping member's medial surface 304*b* is configured with the lateral surface 318*b* of the gasket's inboard portion 314*b*. It is preferable that the footprint of surface 304*a* (e.g., the height) generally match that of surface 318*a*, and that the footprint of surface 304*b* (e.g., the height) generally match that of surface 318*b* as shown in FIG. 4A. However, this may not be necessary.

The surfaces 304*a* and 318*a* may be configured together using one or more attachment mechanisms 320*a*, and the surfaces 304*b* and 318*b* may be configured together using one or more attachment mechanisms 320*b*. In some embodiments, the attachment mechanisms 320*a* may include one or more slots 322*a* in the medial surface 304*a* that may receive and secure corresponding one or more tabs 324*a* extending from the gasket's lateral surface 318*b*. Similarly, the attachment mechanisms 320*b* may include one or more slots 322*b* in the medial surface 304*b* that may receive and secure corresponding one or more tabs 324*b* extending from the gasket's lateral surface 318*b*. The tabs 324*a*, 324*b*, once inserted into the respective slots 322*a*, 322*b*, may be held therein by opposing surfaces (e.g., the tabs 324*a*, 324*b* may be dart shaped) thereby eliminating any costly adhesive bonding process. The attachment mechanisms 320*b* also may provide adequate shear strength to resist being inadvertently removed by the clamping process to the panel 400.

In addition, the outboard clamping member 302*a* may include a bottom medial tab 326*a* that may be received into a recess 328*a* in the bottom outboard side of the gasket member 312, and the inboard clamping member 302*b* may include a bottom medial tab 326*b* that may be received into a recess 328*b* in the bottom inboard side of the gasket member 312. These tab-recess combinations 326*a*-328*a*, 326*b*-328*b* may provide additional attachment support in the bottom region between the clamping members 302*a*, 302*b* and the gasket member 312.

Figure 4B:
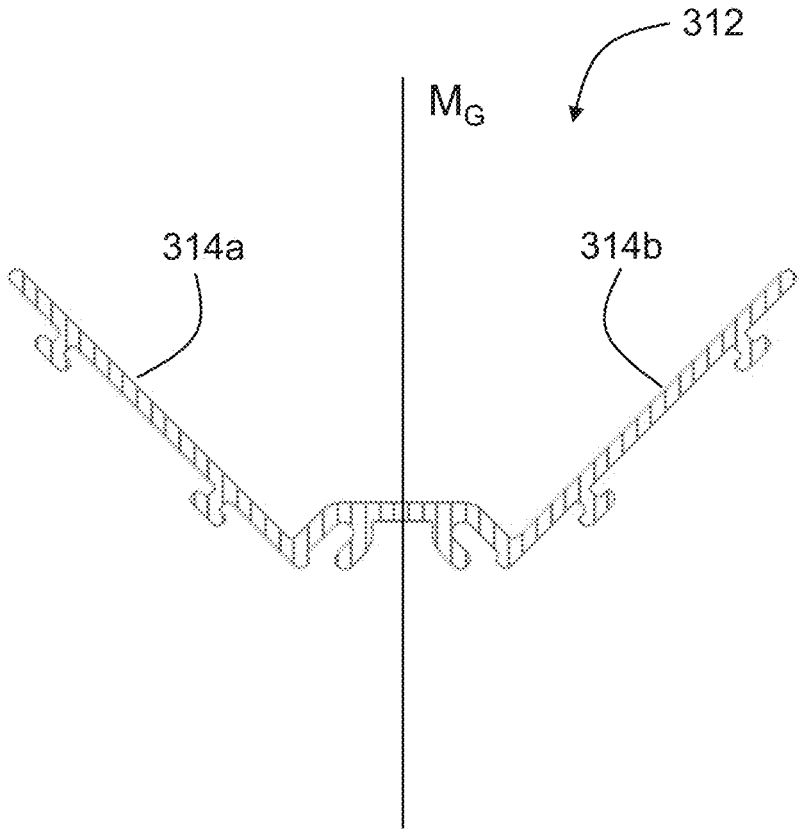
FIG. 4B shows aspects of a gasket according to exemplary embodiments hereof.

In any event, it is preferable that the surfaces 318*a*, 318*b* be held generally tight and flush against the respective surfaces 304*a*, 304*b*. In this way the outboard clamping member 302*a*, the inboard clamping member 302*b* and the gasket member 312 are held together as a unit to generally form the clamping assembly 300 as shown in FIG. 4B. Given this, the gasket member 312 may be referred to as a unitizing gasket 312.

In some embodiments, the gasket member 312, in its at rest and unflexed state, holds the outboard and the inboard clamping members 302*a*, 302*b* apart and separated by a gap G2 (e.g., the gap between opposing bottom tabs 328*a*, 328*b* or between other opposing portions of the members 302*a*, 302*b* if the tabs 328*a*, 328*b* are not present). In some embodiments as shown in FIG. 4B, the gasket member 312 may include a pre-assembly outward bias such that the gasket's outboard portion 314*a* and inboard portion 314*b* may each extend outward from the gasket's bottom 316, each at an acute angle with respect to the median plane $M_G$ of the gasket 312. This outward bias may increase the outward force applied by the gasket portions 314*a*, 314*b* to the clamping members 302*a*, 302*b*, respectively. This may be beneficial during assembly of the rail system 10 onto a horizontally oriented glass panel 400 by counteracting the forces of gravity on the clamping members 302*a*, 302*b* thereby holding them open for the insertion of the panel 400.

As will be described in other sections, when the clamping members 302*a*, 302*b* are moved towards one another in a clamping motion, the bottom portion 330 of the gasket member 312 may be adapted to compress (e.g., kink or bend inward on itself) to accommodate the clamping motion and to allow the gap G2 to decrease accordingly.

The System (Combined Assemblies)

Figure 5:
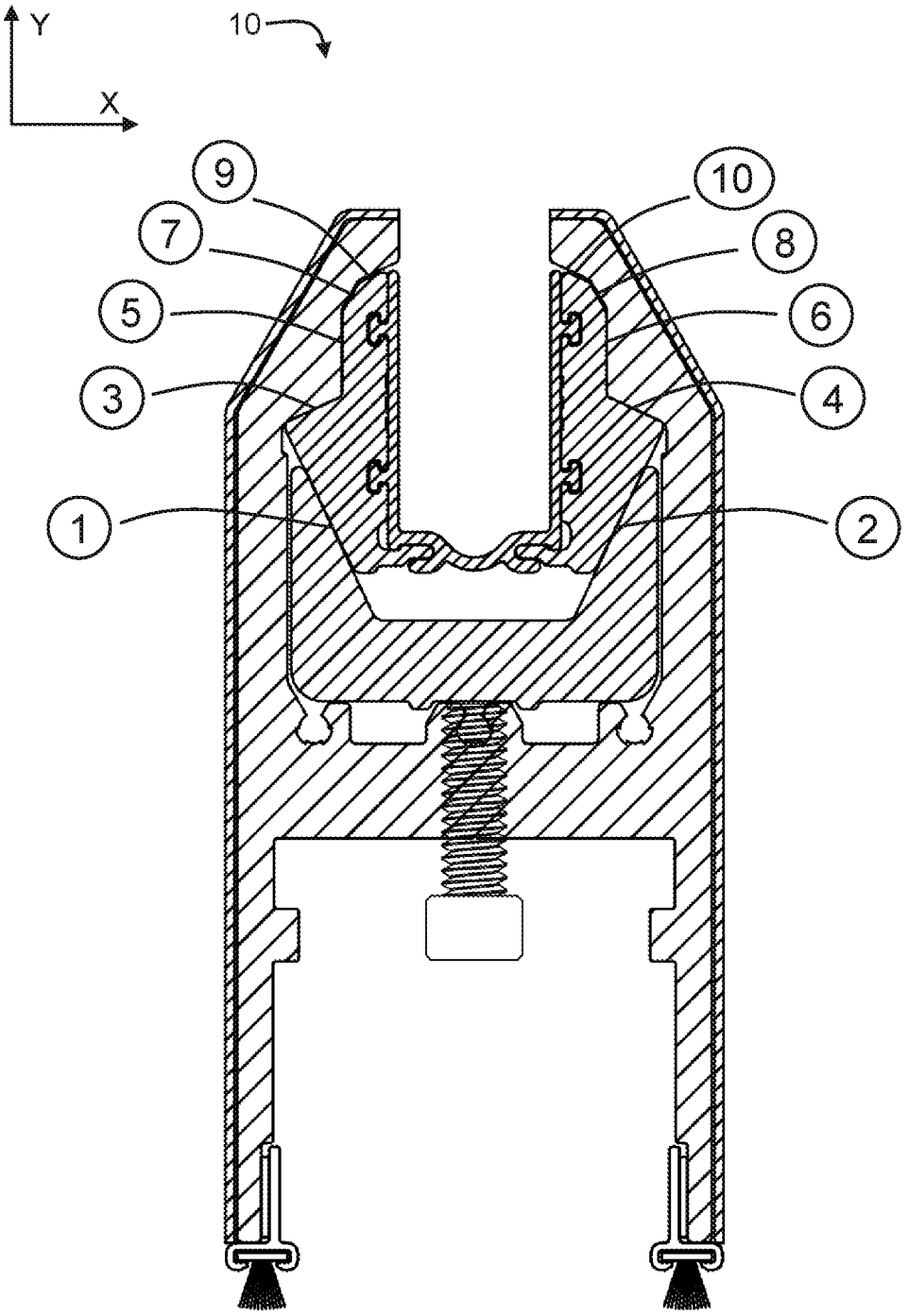
FIG. 5 show aspects of a door rail system according to exemplary embodiments hereof.

In one exemplary embodiment hereof as shown in FIG. 5, the control assembly 200 is configured within the housing assembly 100 as described above with reference to FIG. 2, and the clamping assembly 300 is configured generally within the channel 112 in the area above the mount 202.

In this arrangement, the lower portion (e.g., the first outboard lateral surface 306*a*-1 and the first inboard lateral surface 306*b*-1) of the clamping assembly 300 rests at least partially within the mount's top mount channel 208. In this configuration as shown in FIG. 5, the following surfaces may be generally abutted to form corresponding interfaces (1)-(10):

(1) First outboard lateral surface 306*a*-1 of clamping member 302*a* and outboard medial surface 210*a* of mount 202;
(2) First inboard lateral surface 306*b*-1 of clamping member 302*b* and surface 210*b* of mount 202;
(3) Second outboard lateral surface 306*a*-2 of clamping member 302*a* and second outboard medial surface 108*a*-2 of the housing's outboard portion 102;

(4) Second inboard lateral surface 306*b*-2 of clamping member 302*b* and second inboard medial surface 108*b*-2 of the housing's inboard portion 104;

(5) Third outboard lateral surface 306*a*-3 of clamping member 302*a* and third outboard medial surface 108*a*-3 of the housing's outboard portion 102 (this engagement may be optional since the surfaces may be generally vertical);

(6) Third inboard lateral surface 306*b*-3 of clamping member 302*b* and third inboard medial surface 108*b*-3 of the housing's inboard portion 104 (this engagement may be optional since the surfaces may be generally vertical);

(7) Fourth outboard lateral surface 306*a*-4 of clamping member 302*a* and fourth outboard medial surface 108*a*-4 of the housing's outboard portion 102;

(8) Fourth inboard lateral surface 306*b*-4 of clamping member 302*b* and fourth inboard medial surface 108*b*-4 of the housing's inboard portion 104;

(9) Fifth outboard lateral surface 306*a*-5 of clamping member 302*a* and fifth outboard medial surface 108*a*-5 of the housing's outboard portion 102; and

(10) Fifth inboard lateral surface 306*b*-5 of clamping member 302*b* and fifth inboard medial surface 108*b*-5 of the housing's inboard portion 104.

In some embodiments, at least some of the interfaces (1)-(10) between the surfaces as described above are utilized to translate upward movement(s) of the mount 202 into inward movement(s) of the clamping members 302*a*, 302*b*.

Figure 6:
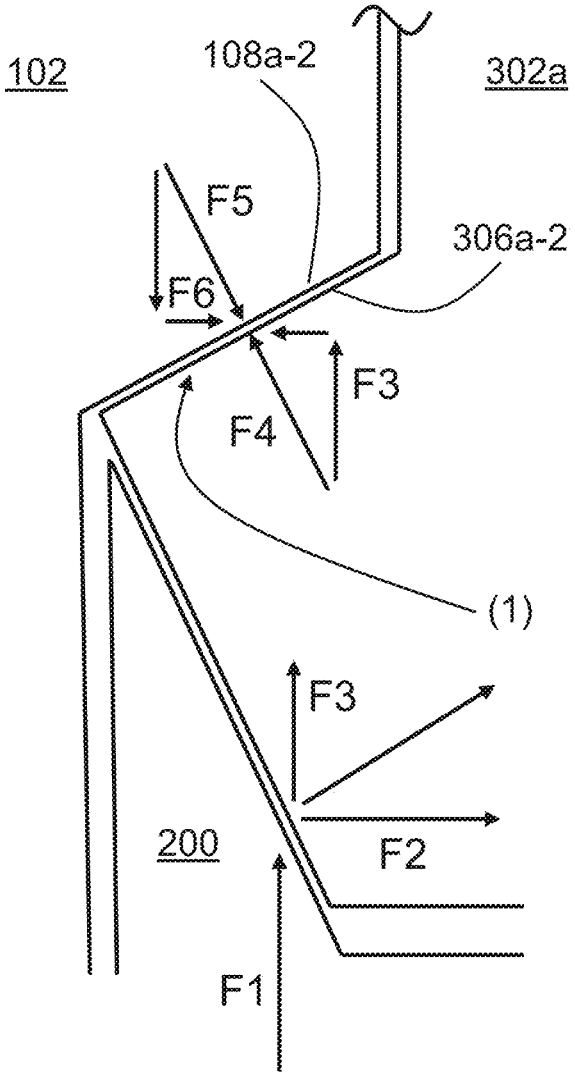
FIG. 6 shows aspects of a clamping assembly to housing interface according to exemplary embodiments hereof.

In general, an upward force F1 applied by the fastening hardware 216 to the bottom 204 of the mount 202 is translated from the mount 202 to the clamping assembly 300. Ignoring frictional elements for the moment, and considering the outboard clamp member 302*a* first as shown in the schematic of FIG. 6 (not meant to be proportional or to scale), the upward force F1 imparted on the clamp member 302*a* by the mount 202 may translate into a horizontal force F2 and a vertical force F3 imparted on the clamp member 302*a*. Force F2 may provide an inward clamping force to the clamp member 302*a*, and force F3 may translate into a normal force F4 applied by the second outboard lateral surface 306*a*-2 to the second outboard medial surface 108*a*-2. As stated in Newton's third law of motion, for every action (force) in nature, there is an equal and opposite reaction (force). Accordingly, the normal force F4 applied to the second outboard medial surface 108*a*-2 results in an opposing normal force F5 applied back to the second outboard lateral surface 306*a*-2. This normal force F5 may then be translated into an inward directed force F6 (towards the median place) applied to the clamp member 302*a*. In this way, the upward force F1 applied by the mount 202 is partially translated into an inward force F6 to the clamp member 302*a*. The inward force F6 causes an inward movement of the clamp member 302*a* thereby providing a supportive clamping motion of the clamp 302*a*.

Figure 7:
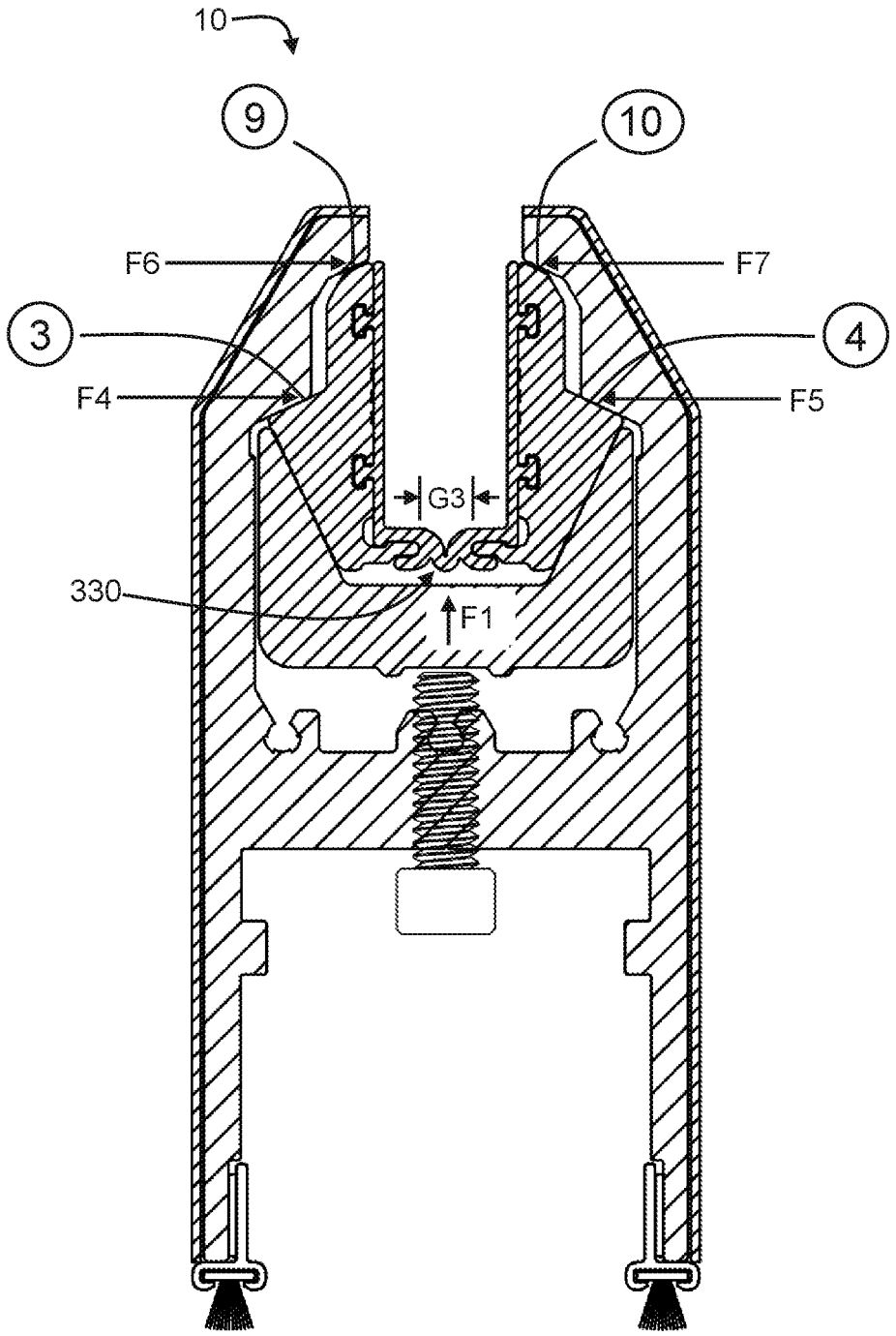
FIGS. 7-8 show aspects of a door rail system according to exemplary embodiments hereof

Applying the same logic to the interface between the second inboard lateral surface 306*b*-2 and the second inboard medial surface 108*b*-2, the upward force F1 applied to the mount 202 is partially translated into an inward force F7 to the inboard clamp member 302*a* (see FIG. 7). The inward force F7 causes an inward movement of the clamp member 302*b* thereby providing a supportive clamping motion of the clamp 302*b*.

In some embodiments, the inward forces F6 and F7 may be generally applied to the middle portion of the clamp members 302*a*, 302*b* where the clamp members 302*a*, 302*b* may be at their thickest (e.g., at interfaces (3) and (4) of FIGS. 5 and 7). Accordingly, in some embodiments, it is preferable to apply additional (and simultaneous) supportive inward forces to the upper portions of the clamp members 302*a*, 302*b* where they may be at their thinnest. This may account for any slight flexing of the clamp members 302*a*, 302*b* during use to further ensure that the overall inward forces applied to the clamp members 302*a*, 302*b* be balanced and uniform across the height of the clamp members 302*a*, 302*b*. In this way, as will be described in other sections, the forces applied by the clamp members' medial surfaces 304*a*, 302*b* to the lateral surfaces of the panel 400 may be uniform and balanced across the surfaces 304*a*, 302*b*.

In addition, by providing two inwardly inclined interfaces on each side of the system 10 (interfaces (3) and (9) on the outboard side and interfaces (4) and (10) on the inboard side), the housing 100 is held more securely in place with respect to the panel 400. The upper opposing inward forces F6, F7 at interfaces (9) and (10), respectively, prevent the housing 100 from becoming angular or otherwise out of parallel with respect to the plane of the glass panel 400.

In some embodiments, and using the same logic applied above, the upward force F1 applied to the mount 202 is partially translated into inward forces F8 and F9 at interfaces (9) and (10), respectively (FIG. 7). In this way, additional supportive inward forces F8 and F9 combined with forces F6 and F7, respectively, may result in uniform inward forces applied to both clamp members 302*a*, 302*b*, respectively, across the height of each clamp member 302*a*, 302*b*.

In some embodiments, it may be preferable that the surface 108*a*-5 be parallel to the surface 108*a*-2 so that the forces F6 and F7 may be vectorially equal. It may also be preferable that the surface 108*b*-5 be parallel to the surface 108*b*-2 so that the forces F8 and F9 may be vectorially equal. In this way, the forces applied at interfaces (3) and (4) may equal the forces applied at interfaces (9) and (10), respectively. In some embodiments, the surfaces 108*a*-2, 108*a*-5, 108*b*-2, 108*b*-5 may be inwardly inclined at 25° towards the median plane of the housing 100. In some embodiments, the surfaces 108*a*-2, 108*a*-5, 108*b*-2, 108*b*-5 may be inwardly inclined at 15°-50° towards the median plane of the housing 100. It is understood that the surfaces 108*a*-2, 108*a*-5, 108*b*-2, 108*b*-5 may be at any inwardly inclined angle towards the median plane of the housing 100 and that the scope of the system 10 is not limited in any way by the angles of the surfaces 108*a*-2, 108*a*-5, 108*b*-2, 108*b*-5.

In some embodiments, it may be preferable that the surface 108*a*-2 and the surface 108*b*-2 be at mirrored angles with one another with respect to the median plane of the housing 100. In some embodiments, it may be preferable that the surface 108*a*-5 and the surface 108*b*-5 be at mirrored angles with one another with respect to the median plane of the housing 100.

In use, as the upward force F1 is applied to the mount 202 by the threaded fastening hardware 216, the mount 202 and the clamping members 302*a*, 302*b* move upward. The inward forces F6 and F8 are applied to the clamping member 302*a*, and the inward forces F7 and F9 are applied to the clamping member 302*b*. As the clamping member 302*a* moves upward, the forces F6, F8 cause the clamping member 302*a* to also move inward while sliding along the interfaces (3) and (9), respectively. Similarly, as the clamping member 302*b* moves upward, the forces F7, F9 cause the clamping member 302*b* to also move inward while sliding along the interface (4) and (10), respectively. These inward movements of clamping members 302*a*, 302*b* result in the clamping motion of the clamping assembly 300. In some embodiments, it may be preferable that the interfaces (3), (9), (4) and (10) be smooth and free of obstructions or excessive friction so that the clamping members 302*a*, 302*b* may slide along the interfaces smoothly and without jarring. In some embodiments, the inward force F2 (and a similar inward force applied to the clamping member 302*b*) may negate some of the frictional forces that may be formed by the movement of the abutted surfaces moving over one another.

In some embodiments, the unitizing gasket 312 holds the clamping members 302*a*, 302*b* in position during the clamping motion during which the gap G2 may be reduced (as the members 302*a*, 302*b* approach one another). As shown as shown in FIG. 7, the bottom portion 330 of the gasket member 312 may be adapted to compress (e.g., kink or bend inward on itself) to accommodate the clamping motion and to allow the gap G2 to decrease (e.g., to decrease to a smaller gap G3). In this way, the unitizing gasket 312 may continue to hold the clamping members 302*a*, 302*b* in position while its bottom portion 330 may compress.

In some embodiments, the bottom of the panel 400 may be inserted into the clamping assembly's channel 310 and the threaded fastening hardware 216 may be rotated to cause the inward clamping motions of the clamping members 302*a*, 302*b*. This in turn causes the clamping members 302*a*, 302*b* to clamp and thereby hold and support the panel 400 within the system 10. The slight inward inclinations of the interfaces (3), (9), (4) and (10) minimize any change in the panel's penetration depth in the channel 310 throughout the panel thickness adjustment range, leaving the panel height relatively unchanged during the clamping process. This may also maintain parallelism of the panel rail with respect to the plane of the panel 400 and may aid in equalizing the force distribution along the panel 400 imposed by the gasket 312 contact surfaces.

It is understood by a person of ordinary skill in the art, upon reading this specification, that while various embodiments have been described herein as having two distinct mating interfaces between the clamping assembly 300 and the housing on the outboard side of the system 10 (e.g., interfaces (3) and (9)), and two distinct mating interfaces between the clamping assembly 300 and the housing on the inboard side of the system 10 (e.g., interfaces (4) and (10)), the system 10 may include any number of mating interfaces on either its outboard and/or inboard sides. For example, the outboard and/or inboard sides may include 3, 4, 5, 6, 7, 8, 9, 10 or more mating interfaces. In this way, the force applied by the mount 202 to the clamping members 302*a*, 302*b* and the resulting forces applied by the clamping members 302*a*, 302*b* to the panel 400 may be uniform and evenly distributed along the vertical height of the clamping members 302*a*, 302*b*.

Figure 8:
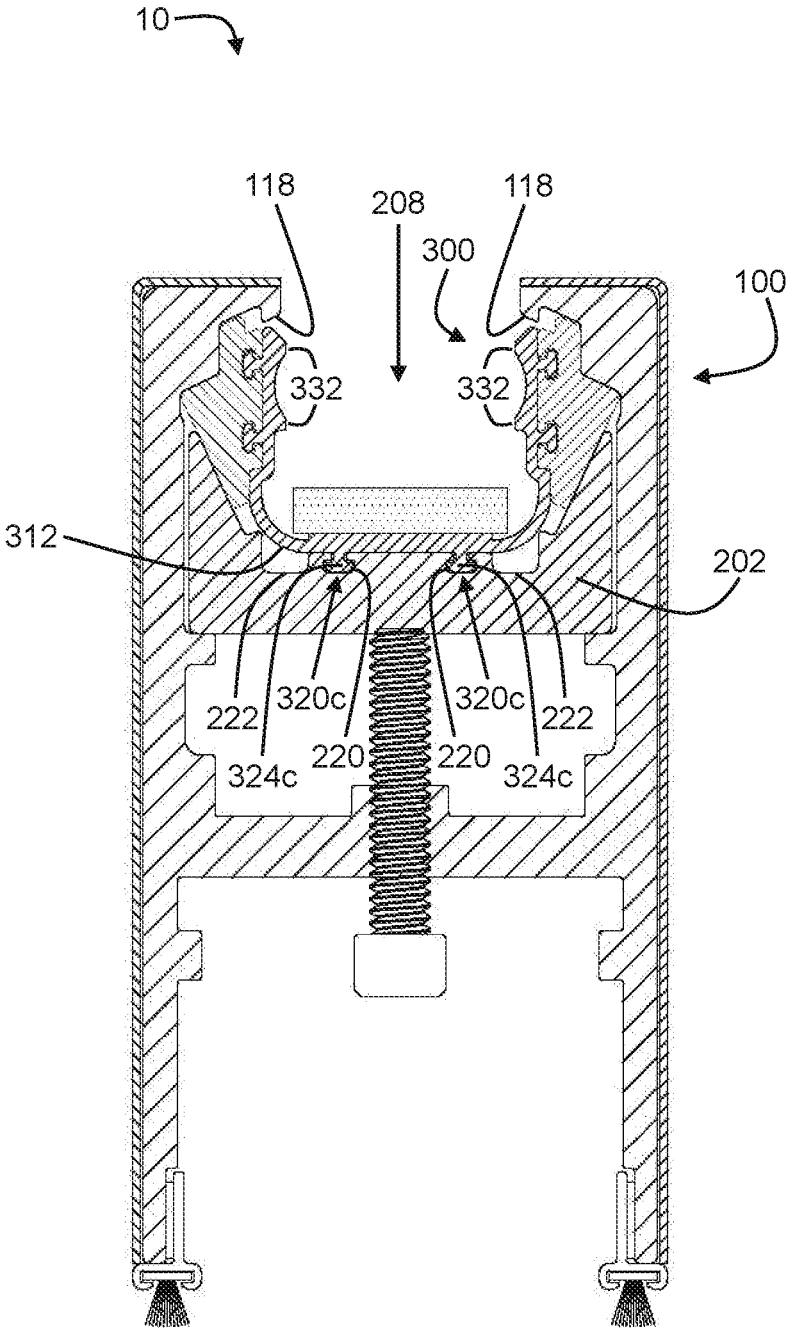

In one exemplary embodiment, the outboard and/or inboard portions 102, 104 may include stops to regulate the upward travel of the clamping assembly 300. In one embodiment, one or more medial surfaces 108*a*, 108*b* may include one or more lips 118 that may be positioned to restrict movement of the clamping members 302*a*, 302*b* at certain positions (e.g., at the top end of the medial surfaces 108*a*, 108*b*). For example, as shown in FIG. 8, medial surfaces 108*a*-5, 108*b*-5 include downward pointing lips 118 that may act as end stops to the upper portions of the clamping members 302*a*, 302*b*. It is understood that stops may be positioned on other medial surfaces 108*a*, 108*b* to regulate the movement of the clamping members 302*a*, 302*b* on those other medial surfaces 108*a*, 108*b*.

In one exemplary embodiment, the outboard and/or inboard portions 102, 104 may include one or more clamping force limit stops to limit the downward movement of the clamping members 302*a*, 302*b* within the top mount channel 208 relative to the mount 202. In one embodiment, the outboard upper medial surface 210*a* and/or inboard upper medial surface 210*b* may include one or more lips 120 that may be positioned to block movement of the clamping members 302*a*, 302*b*. For example, as shown in FIG. 8, upper medial surfaces 210*a*, 210*b* include upward pointing lips 120 that may act as stops to the lower portions of the clamping members 302*a*, 302*b*.

In one exemplary embodiment hereof as shown in FIG. 8, the unitizing gasket 312 includes pressure concentrating ridges, and optionally integrated hollow bulb seals 332 placed to form a weather seal when in contact with the panel 400.

In one exemplary embodiment hereof as shown in FIG. 8, the unitizing gasket 312 may include attachment mechanisms 320*c* that may secure its bottom portion 330 within the mount's top mount channel 208. In this way, the clamping assembly 300 may be configured with the mount 202. In some embodiments, the attachment mechanisms 320*c* may include one or more slots 220 in the bottom 212 of the top mount channel 208 adapted to receive and secure corresponding tabs 324*c* extending downward from the bottom portion 330 of the gasket 312. The tabs 324*c*, once inserted into the respective slots 220, may be held therein by opposing surfaces (e.g., the tabs 324*c* may be dart shaped) thereby eliminating any costly adhesive bonding process. The attachment mechanisms 320*c* also may provide adequate shear strength to resist being inadvertently removed by the clamping process to the panel 400.

In this configuration, the bottom portion 330 of the gasket member 312 may be adapted to compress (e.g., kink or bend inward on itself or into side recesses 222 in the mount 202) to accommodate the clamping motion and to allow the gap G2 to decrease accordingly.

Benefits of the System

The benefits of the system 10 are multifold and include, without limitation:

First, having two vertically offset force-providing interfaces (3), (9) on the outboard side and two vertically offset force-providing interfaces (4), (10) on the inboard side provides a uniform force across the vertical height of each clamping member 302*a*, 302*b*, respectively. This in turn results in uniform clamping forces applied by the clamping members 302*a*, 302*b* to the lateral sides of the panel 400 when in use, thereby minimizing strain and stress to the system 10. In addition, the upper opposing inward forces F6, F7 at interfaces (9) and (10), respectively, prevent the housing 100 from becoming angular or otherwise out of parallel with respect to the plane of the glass panel 400.

Second, the unitizing gasket 312 holds the outboard and inboard clamping members 302*a*, 302*b* in proper relation to one another for the insertion of the clamping assembly 300 into the housing assembly 100.

Third, the unitizing gasket 312 holds the outboard and inboard clamping members 302*a*, 302*b* in proper relation to one another with an adequate gap therebetween (channel 310) for the loading of the panel 400 into the channel 310 for subsequent clamping of the panel 400. This also eliminates the need for temporary spacer blocks.

Fourth, the unitizing gasket 312 provides a cushioned yet gripping interface between the clamping members 302*a*, 302*b* and the panel 400 when clamped.

Fifth, the unitizing gasket 312 minimizes the need for adhesives within the system 10 (e.g., between the panel 400 and the clamping members 302*a*, 302*b*, etc.).

Sixth, the unitizing gasket 312 provides a weather seal between the rail system 10 and the panel 400.

It is understood that the benefits shown above are meant for demonstration and that other benefits of the system 10 may also exist. Those of ordinary skill in the art will appreciate and understand, upon reading this description, that embodiments hereof may provide different and/or other advantages, and that not all embodiments or implementations need have all advantages.

Where a process is described herein, those of ordinary skill in the art will appreciate that the process may operate without any user intervention. In another embodiment, the process includes some human intervention (e.g., a step is performed by or with the assistance of a human).

As used herein, including in the claims, the phrase "at least some" means "one or more," and includes the case of only one. Thus, e.g., the phrase "at least some ABCs" means "one or more ABCs", and includes the case of only one ABC.

As used herein, including in the claims, term "at least one" should be understood as meaning "one or more", and therefore includes both embodiments that include one or multiple components. Furthermore, dependent claims that refer to independent claims that describe features with "at least one" have the same meaning, both when the feature is referred to as "the" and "the at least one".

As used in this description, the term "portion" means some or all. So, for example, "A portion of X" may include some of "X" or all of "X". In the context of a conversation, the term "portion" means some or all of the conversation.

As used herein, including in the claims, the phrase "using" means "using at least," and is not exclusive. Thus, e.g., the phrase "using X" means "using at least X." Unless specifically stated by use of the word "only", the phrase "using X" does not mean "using only X."

As used herein, including in the claims, the phrase "based on" means "based in part on" or "based, at least in part, on," and is not exclusive. Thus, e.g., the phrase "based on factor X" means "based in part on factor X" or "based, at least in part, on factor X." Unless specifically stated by use of the word "only", the phrase "based on X" does not mean "based only on X."

In general, as used herein, including in the claims, unless the word "only" is specifically used in a phrase, it should not be read into that phrase.

As used herein, including in the claims, the phrase "distinct" means "at least partially distinct." Unless specifically stated, distinct does not mean fully distinct. Thus, e.g., the phrase, "X is distinct from Y" means that "X is at least partially distinct from Y," and does not mean that "X is fully distinct from Y." Thus, as used herein, including in the claims, the phrase "X is distinct from Y" means that X differs from Y in at least some way.

It should be appreciated that the words "first," "second," and so on, in the description and claims, are used to distinguish or identify, and not to show a serial or numerical limitation. Similarly, letter labels (e.g., "(A)", "(B)", "(C)", and so on, or "(a)", "(b)", and so on) and/or numbers (e.g., "(i)", "(ii)", and so on) are used to assist in readability and to help distinguish and/or identify, and are not intended to be otherwise limiting or to impose or imply any serial or numerical limitations or orderings. Similarly, words such as "particular," "specific," "certain," and "given," in the description and claims, if used, are to distinguish or identify, and are not intended to be otherwise limiting.

As used herein, including in the claims, the terms "multiple" and "plurality" mean "two or more," and include the case of "two." Thus, e.g., the phrase "multiple ABCs," means "two or more ABCs," and includes "two ABCs." Similarly, e.g., the phrase "multiple PQRs," means "two or more PQRs," and includes "two PQRs."

The present invention also covers the exact terms, features, values and ranges, etc. in case these terms, features, values and ranges etc. are used in conjunction with terms such as about, around, generally, substantially, essentially, at least etc. (i.e., "about 3" or "approximately 3" shall also cover exactly 3 or "substantially constant" shall also cover exactly constant).

As used herein, including in the claims, singular forms of terms are to be construed as also including the plural form and vice versa, unless the context indicates otherwise. Thus, it should be noted that as used herein, the singular forms "a," "an," and "the" include plural references unless the context clearly dictates otherwise.

Throughout the description and claims, the terms "comprise", "including", "having", and "contain" and their variations should be understood as meaning "including but not limited to", and are not intended to exclude other components unless specifically so stated.

It will be appreciated that variations to the embodiments of the invention can be made while still falling within the scope of the invention. Alternative features serving the same, equivalent or similar purpose can replace features disclosed in the specification, unless stated otherwise. Thus, unless stated otherwise, each feature disclosed represents one example of a generic series of equivalent or similar features.

The present invention also covers the exact terms, features, values and ranges, etc. in case these terms, features, values and ranges etc. are used in conjunction with terms such as about, around, generally, substantially, essentially, at least etc. (i.e., "about 3" shall also cover exactly 3 or "substantially constant" shall also cover exactly constant).

Use of exemplary language, such as "for instance", "such as", "for example" ("e.g.,") and the like, is merely intended to better illustrate the invention and does not indicate a limitation on the scope of the invention unless specifically so claimed.

While the invention has been described in connection with what is presently considered to be the most practical and preferred embodiments, it is to be understood that the invention is not to be limited to the disclosed embodiment, but on the contrary, is intended to cover various modifications and equivalent arrangements included within the spirit and scope of the appended claims.

I claim:

1. A rail system for releasably securing a panel, the rail system comprising:

a rail body;

a first clamping member;

a second clamping member opposing the first clamping member forming a space therebetween adapted to secure the panel;

a mount with an upper portion and a lower portion, the upper portion adapted to engage the first clamping member and/or the second clamping member;

a first inwardly inclined interface and a second inwardly inclined interface between the rail body and the first clamping member;

a third inwardly inclined interface and a fourth inwardly inclined interface between the rail body and the second clamping member;

a movement mechanism adapted to apply a first movement force to the lower portion of the mount;

wherein the first movement force is translated into a first inward force applied to the first clamping member at the first inwardly inclined interface, a second inward force applied to the first clamping member at the second inwardly inclined interface, a third inward force applied to the second clamping member at the third inwardly inclined interface, and a fourth inward force applied to the second clamping member at the fourth inwardly inclined interface;

wherein the first, second, third and fourth inward forces generate first opposing clamping forces between the first and second clamping members to secure the panel therebetween.

2. The rail system of claim 1 further comprising:

a first outwardly inclined interface between the first clamping member and the upper portion of the mount;

a second outwardly inclined interface between the second clamping member and the upper portion of the mount;

wherein the first movement force is further translated into a fifth inward force applied to the first clamping member at the first outwardly inclined interface, and a sixth inward force applied to the second clamping member at the second outwardly inclined interface;

wherein the fifth and sixth inward forces generate second opposing clamping forces between the first and second clamping members to secure the panel therebetween.

3. The rail system of claim 2 wherein the first outwardly inclined interface and/or the second outwardly inclined interface includes a stop.

4. The rail system of claim 1 wherein the first inwardly inclined interface and the third inwardly inclined interface are opposing interfaces, and/or the second inwardly inclined interface and the fourth inwardly inclined interface are opposing interfaces.

5. The rail system of claim 1 wherein the first inwardly inclined interface and the second inwardly inclined interface are vertically offset, and/or the third inwardly inclined interface and the fourth inwardly inclined interface are vertically offset.

6. The rail system of claim 1 wherein the first clamping member includes a first clamping surface, and the second clamping member includes a second clamping surface opposing the first clamping surface, wherein the space adapted to secure the panel is between the first and second clamping surfaces.

7. The rail system of claim 6 further comprising a gasket having a first portion configured with the first clamping surface, and a second portion configured with the second clamping surface, the gasket adapted to provide an interface between the first and second clamping surfaces and the panel to be secured.

8. The rail system of claim 7 wherein the gasket is adapted to hold the first and second clamping members in an opposing position.

9. The rail system of claim 7 wherein the gasket's first portion and second portion each includes an outward bias.

10. The rail system of claim 7 wherein the gasket further comprises a bottom portion configured between the first portion and the second portion, wherein the bottom portion is adapted to compress and/or fold when the first opposing clamping forces are generated.

11. The rail system of claim 1 wherein the first inwardly inclined interface, the second inwardly inclined interface, the third inwardly inclined interface and/or the fourth inwardly inclined interface include a stop.

12. A rail system for releasably securing a panel having at least one major surface defining a first plane, the rail system comprising:

a rail body having a channel, the channel adapted to receive the panel and defined by a first side comprising at least two first side surfaces, and a second side comprising at least two second side surfaces, the at least two first side surfaces and the at least two second side surfaces each inclined towards the first plane;

a mount configured within the channel, the mount including a mount channel defined by a first mount channel side and a second mount channel side, the first mount channel side and the second mount channel side each inclined away from the first plane;

a first clamping member comprising a first clamping member first surface adapted to interface with a first of the at least two first side surfaces at a first interface, a first clamping member second surface adapted to interface with a second of the at least two first side surfaces at a second interface, and a first clamping member third surface adapted to interface with the first mount channel side at a third interface;

a second clamping member comprising a second clamping member first surface adapted to interface with a first of the at least two second side surfaces at a fourth interface, a second clamping member second surface adapted to interface with a second of the at least two second side surfaces at a fifth interface, and a second clamping member third surface adapted to interface with the second mount channel side at a sixth interface;

wherein a force applied to a side of the mount opposite the mount channel translates into first, second and third inward forces applied to the first clamping member at the first, second and third interfaces, respectively, and fourth, fifth and sixth inward forces applied to the second clamping member at the fourth, fifth and sixth interfaces, respectively;

wherein the first, second, third, fourth, fifth and sixth inward forces generate opposing clamping forces between the first and second clamping members to secure the panel therebetween.

13. The rail system of claim 12 wherein the at least two first side surfaces are vertically offset with respect to one another, and/or the at least two second side surfaces are vertically offset with respect to one another.

14. The rail system of claim 12 wherein a first of the at least two first side surfaces and a first of the at least two second side surfaces are opposing surfaces, and/or a second of the at least two first side surfaces and a second of the at least two second side surfaces are opposing surfaces.

15. The rail system of claim 12 wherein the first clamping member includes a first clamping surface, and the second clamping member includes a second clamping surface opposing the first clamping surface, wherein the generated opposing clamping forces between the first and second clamping members include opposing clamping forces between the first and second clamping surfaces.

16. The rail system of claim 15 further comprising a gasket having a first portion configured with the first clamping surface, and a second portion configured with the second clamping surface, the gasket adapted to provide an interface between the first and second clamping surfaces and the panel to be secured.

17. The rail system of claim 16 wherein the gasket is adapted to hold the first and second clamping members in an opposing position.

18. The rail system of claim 16 wherein the gasket's first portion and second portion each includes an outward bias.

19. The rail system of claim 16 wherein the gasket further comprises a bottom portion configured between the first portion and the second portion, wherein the bottom portion is adapted to compress and/or fold when the first opposing clamping forces are generated.

20. The rail system of claim 12 wherein the first interface, second interface, third interface, fourth interface, fifth interface and/or sixth interface includes a stop.

* * * * *